US006822614B2

(12) United States Patent
Chiu

(10) Patent No.: US 6,822,614 B2
(45) Date of Patent: Nov. 23, 2004

(54) LOOP ANTENNA

(75) Inventor: Chien-Chih Chiu, Dali (TW)

(73) Assignee: Darfon Electronics Corp., Taoyuan (TW)

( * ) Notice: Subject to any disclaimer, the term of this patent is extended or adjusted under 35 U.S.C. 154(b) by 0 days.

(21) Appl. No.: 10/336,537

(22) Filed: Jan. 3, 2003

(65) Prior Publication Data

US 2003/0132889 A1 Jul. 17, 2003

(30) Foreign Application Priority Data

Jan. 4, 2002 (TW) ..... 91100053 A

(51) Int. Cl.[7] ..... H01Q 11/12
(52) U.S. Cl. ..... 343/741; 343/866; 343/870
(58) Field of Search ..... 343/788, 787, 343/741, 866, 742, 744, 867, 743, 895, 870

(56) References Cited

U.S. PATENT DOCUMENTS

| | | | | | |
|---|---|---|---|---|---|
| 2,375,593 | A | * | 5/1945 | Sontheimer et al. | 343/788 |
| 3,495,264 | A | * | 2/1970 | Spears | 343/788 |
| 5,442,369 | A | * | 8/1995 | Van Voorhies et al. | 343/742 |
| 5,633,648 | A | * | 5/1997 | Fischer | 343/788 |
| 6,204,821 | B1 | * | 3/2001 | Van Voorhies | 343/742 |
| 6,218,998 | B1 | * | 4/2001 | Van Voorhies | 343/741 |
| 6,437,751 | B1 | * | 8/2002 | Craven et al. | 343/742 |

* cited by examiner

*Primary Examiner*—Hoang V. Nguyen
(74) *Attorney, Agent, or Firm*—Ladas & Parry LLP

(57) ABSTRACT

A loop antenna system. The loop antenna system for a wireless transmission device having a signal end and a ground end, includes a loop antenna having a toroidal helix wire with a first end coupled to the signal end and a second end coupled to the ground end.

14 Claims, 10 Drawing Sheets

LOOP ANTENNA

BACKGROUND OF THE INVENTION

1. Field of the Invention

The present invention relates to a loop antenna, and particularly to a loop antenna making use of a ground conductor plate for inducing image charge to enhance radiation efficiency.

2. Description of the Related Art

For emerging wireless transmission devices, dimensions of antennas have great effects on wireless transmission and must be in the order of the radio wavelength for transmission efficiency. However, in some bandwidths, radio wavelengths are much longer than the length of antenna that wireless transmission devices can afford, such that radiation efficiency is very low. In order to improve radiation efficiency, It is necessary to use complicated antennas and RF circuits. That will causein the wireless system in high cost, low yield, and high power consumption. Thus, the benefits of wireless transmission are lost. To improve radiation efficiency, it is necessary to make use of ground conductor plates within wireless devices and polarization of signal source of an antenna.

Most conventional loop antennas are magnetic dipoles. When the conventional loop antennas are using near a ground metallic plate, their radiation efficiencies will be reduced by the ground metallic plate.

A block diagram of a wireless mouse with a conventional magnetic dipole loop antenna is shown in FIG. 1. RF module 220 includes an amplifier 520, a phase lock loop circuit 450, a filter 470, and a voltage control oscillator 480. The base band circuit includes a CPU 420, a shift encoder 300, a memory 440 such as non-volatile memory EEPROM, and a switch 550. The first end of the loop antenna 240 is coupled to the signal end of the amplifier 520. The second end of the loop antenna 240 is coupled to the ground end of the amplifier 520.

When the wireless mouse operated, the CPU 420 reads out the channel frequencies, the sampling frequencies of the photo detector 310, and the identification code from the memory 440. The identification code identifies different wireless mice in the same transmission region and the same transmission frequency. For a same computer, each wireless mouse has a unique identification code. When the wireless mouse is powered up, the memory 440 records and updates the peripheral identification code of the computer.

The CPU 420 controls the channel frequencies by controlling the modulation frequency by the phase lock loop circuit 450. The CPU reads the data of the transmission channel frequency from memory 440, and sends the data to the phase lock loop circuit 450 to generate the carrier signal of the transmission channel. The user can use the channel select key 500 to select the transmission channel from the memory 440.

The CPU 420 provides a determined information to modulator 560 to modulate the transmitted signal. The modulator 560 comprises a voltage control conciliator (VCXO) in series with a crystal to generate a reference frequency and uses this frequency to work as a FSK modulator. The modulator 560, the phase lock loop circuit 450, the filter 470, and the voltage control oscillator form a feedback loop which generates a RF carrier signal with precise frequency. The RF carrier signal is fed into the circular loop antenna 241 through the amplifier 520. The modulated reference frequency of the modulator 560 is generated by switching over resonance capacitors of the reference oscillator. The reference frequency is changed by the resonance capacitor that is FSK modulation. The signals of switching over is the encode data of the mouse operation. The filter must have enough bandwidth to track the modulation of the reference frequency.

When the wireless mouse used on a metallic table which acting as a ground conductor plate, that causes cancellation of the magnetic dipole source. The input impedance of the loop antenna 240 changes, that will shorten the transmission distance of the wireless mouse. A diagram of the loop antenna 240 and the ground conductor plate 230 is shown in FIG. 2. The wireless mouse is used on the ground conductor plate 230. The first end of the loop antenna is coupled to the signal end of the amplifier 520, and the second end of the loop antenna 240 is coupled to the ground end of the RF module 220. The loop antenna 240 is using upon the ground conductor plate 230 and parallels closely to the ground conductor plate 230. The current of the loop antenna 240 is parallel to the ground conductor plate 230. Owing to good conduct characteristic of the ground conductor plate 230, the current of the loop antenna 240 induces an image current distribution in the ground conductor plate which makes the tangential electric field is zero. The image magnetic dipole source caused by the image current is opposite to the magnetic dipole source in the current of the loop antenna 240, as shown in FIG. 3. Therefore, the image magnetic dipole reduced the radiation intensity of the loop antenna 240. Usually, the wireless mouse is used on the surface of a table. The distance between the wireless mouse and the table is small. Thus, as the desk-top of the table is made by conduct plate 230, when the distance between the loop antenna 240 and the ground conductor plate 230 is smaller the effect of reduced radiation intensity is more significant.

It is necessary to design an antenna system not only reduced but also enhanced radiation intensity. It is also necessary to take advantage of a conductor plate when a wireless transmission device is using on it.

SUMMARY OF THE INVENTION

It is therefore an object of the present invention to provide a loop antenna enhanced by an environment with a ground conductor plate.

To achieve the above objects, the present invention provides a loop antenna system. According to the embodiment of the invention, the loop antenna system includes a ground conductor plate coupled to a ground end and a loop antenna having a helix wire wounded on a toroid. The helix wire has a first end coupled to the ground end. The toroid has a principal axis AX1 and a minor axis AX2. The principal AX1 is perpendicular to the ground conductor plate. The minor AX2 is parallel to the ground conductor plate.

When the radio wavelength of the transmission signal is beyond the dimensions of the loop antenna, the magnetic current is distributed along the minor axis AX2, and the electric dipole is along the principal axis AX1 and perpendicular to the ground conductor plate.

BRIEF DESCRIPTION OF THE DRAWINGS

The aforementioned objects, features and advantages of this invention will become apparent by referring to the following detailed description of the preferred embodiment with reference to the accompanying drawings, wherein.

DETAILED DESCRIPTION OF THE INVENTION

The loop antenna systems in the following embodiments mainly make use of an electric dipole of the toroidal helical wire and a ground conductor plate for inducing image electric dipole having the same direction to enhance radiation intensity.

The polarity of the induced image magnetic dipole is opposite that of the actual magnetic dipole and lessens radiation capability. By the duality principle of electromagnetics, if an electric field is replaced by magnetic field, magnetic field by opposite electric field, permittivity by permeability, permeability by permittivity, electric current by magnetic current, and magnetic current by electric current, the electromagnetic fields caused by the electric dipole can be obtained from the magnetic dipole.

The First Embodiment

Figure 4:
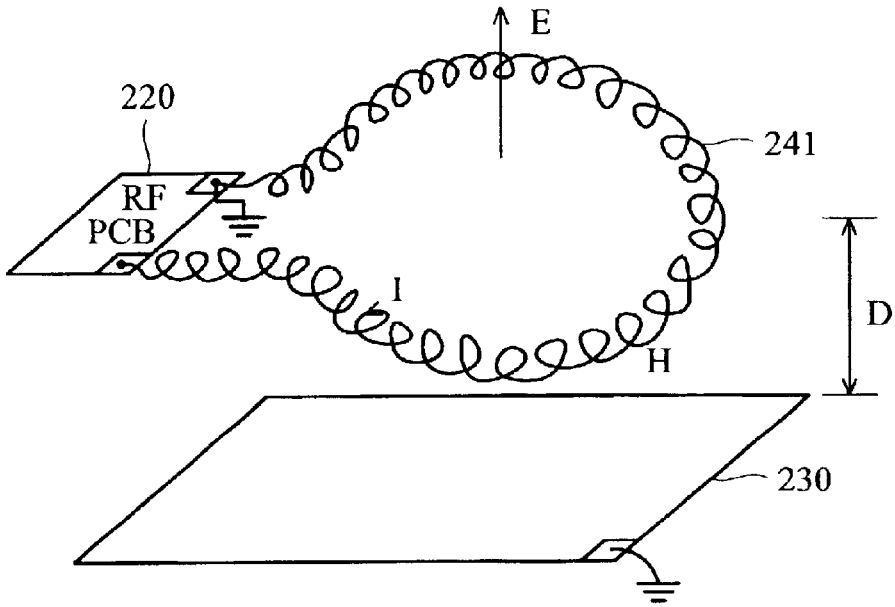
FIG. 4 shows a loop antenna system according to a embodiment of the present invention.
Figure 5:
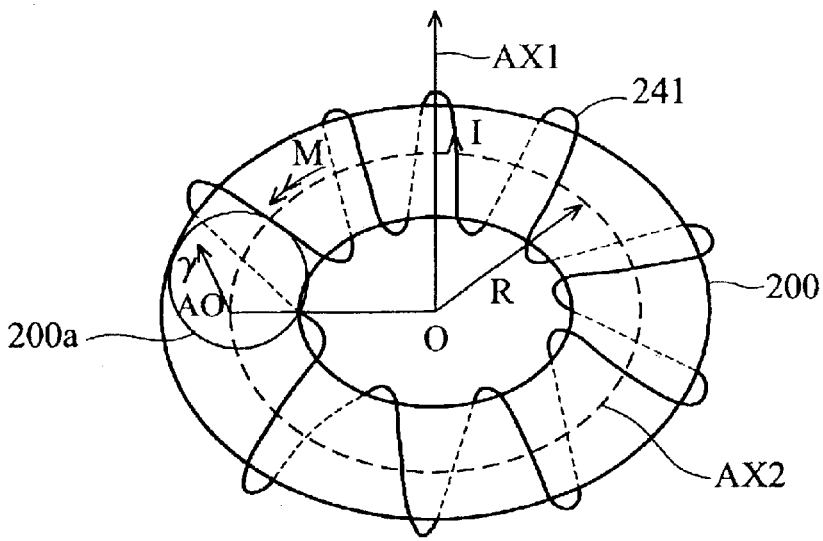
FIG. 5 shows a stereoscope of the loop antenna with a circular toroidal helix wire and a circular cross-section.
Figure 6:
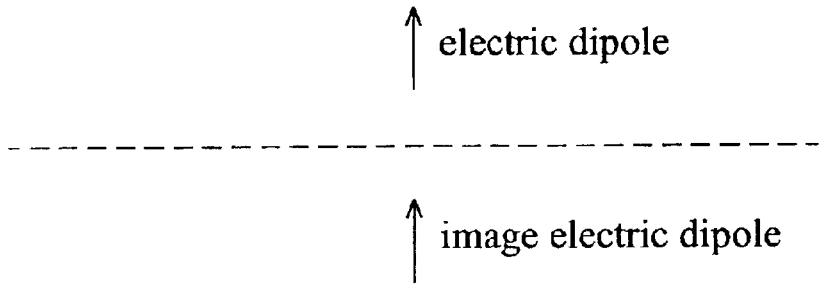
FIG. 6 shows a diagram of an electric dipole of a loop antenna and an image electric dipole.

An electric dipole is induced by a magnetic current of a toroidal helix wire, as the circular loop antenna 241 shown in FIG. 4, which discloses an embodiment of a toroid with a circular cross section. A magnetic current replaces the electric current in the loop antenna having a magnetic dipole. The magnetic current is proportional to the changing rate of the magnetic flux density. FIG. 5 shows a stereoscope of the toroidal helix wire of the circular loop antenna 241. The circular loop antenna 241 is formed by a toroidal helix wire wound on a circular toroid 200. From the top-view of the circular loop antenna, the circular toroid 200 is circular. From the side view, the circular toroid 200 has a circular section 200*a*. The circular toroid 200 can be a ferrite core with a circular cross section or a hollow space enclosed by the circular loop antenna 241. The circular toroid 200 has a major axis AX1, a minor axis AX2, a radius R, and a radius r. The major axis AX1 is perpendicular to a plane which the circular toroid is on. The minor axis AX2 is a circle with a radius r. The circular toroid 200 has a surface with a constant distance from the minor axis AX2. When the magnetic flux is uniform, the magnetic current is equivalently distributed in the minor axis coincident with the electric current in the loop antenna having a magnetic dipole. The electric dipole is coincident with the major axis AX1. A ground conductor plate 230 is under the circular loop antenna 241. When the wavelength of the transmission signals exceeds the length of the circular loop antenna 241, the magnetic current loop antenna is equivalent to an electric dipole antenna, perpendicular to the ground conductor plate 230. As shown in FIG. 6, the tangential electric field of the ground conductor plate 230 being zero can be achieved by replacing the ground conductor plate 230 with an image electric dipole with the same direction. Therefore, the image electric dipole enhances the radiation fields of the circular loop antenna 241. The smaller the distance between the circular loop antenna 241 and the ground conductor plate 230, the more significant the enhancement.

The Second Embodiment

Figure 7A:
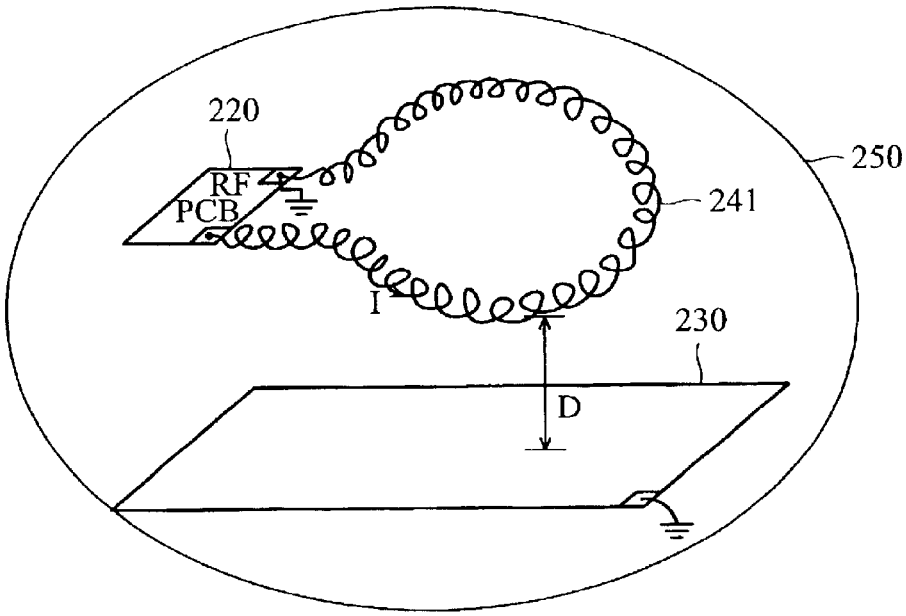
FIGS. 7A–7C shows a diagram rendition of application of the loop antenna with a circular toroidal helix wire.
Figure 8:
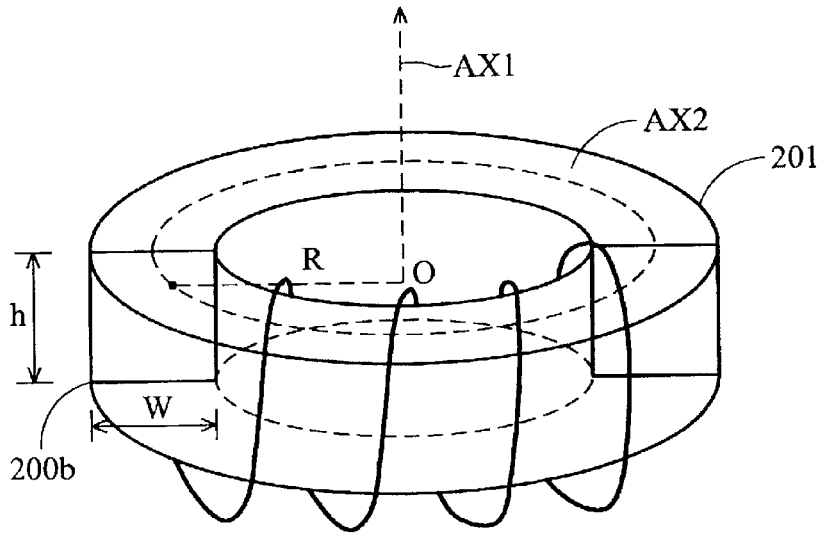
FIG. 8 shows a stereoscope of the loop antenna with a circular toroidal helix wire and a rectangular cross-section.

FIG. 8 shows a stereoscope of the toroidal helix wire of the circular loop antenna 241. FIG. 8 discloses an embodiment of a toroid with a rectangular cross section. The circular loop antenna 241 is formed by a toroidal helix wire on a circular toroid 201. Viewed from above, the circular toroid 201 is cicular shape. Viewed from the side, the circular toroid 201 has a rectangular section 200*b*. The circular toroid 201 can be a ferrite core with a rectangular cross section or a hollow space enclosed by the circular loop antenna 241. The circular toroid 201 has a major axis AX1, a minor axis AX2, a radius R, a width, and a height. The major axis AX1 is perpendicular to a plane on which the circular toroid is located. The minor axis AX2 is a circle formed with a radius R. The circular toroid 201 has a rectangular cross-section with a width w and a height h. The circular toroid 201 is a surface formed by revolving the rectangle about the major axis. An embodiment of applying the circular loop antenna 241 to a wireless mouse is shown in FIG. 7A. The ground conductor plate 230 is at the bottom of the wireless mouse 250. The first end of the circular loop antenna 241 is coupled to the signal end of the RF module 220, and the second end is coupled to the ground end of the RF module 220. The circular loop antenna 241 is above and parallel close to the ground conductor plate 230. The ground conductor plate 230 is coupled to the ground of the RF module, thus the RF module 220 and ground conductor plate have the same ground.

Owing to conduct characteristics of the ground conductor plate 230, the tangential electric field of the ground conductor plate 230 being zero can be achieved by replacing the ground conductor plate 230 with an image electric dipole. Because the magnetic current in the circular loop antenna 241 is parallel to the ground conductor plate 230, the image magnetic current flows in the same direction with the magnetic current in the loop antenna 241 and the image electric dipole is in the same direction. Therefore, the image electric dipole enhances the radiation fields of the circular loop antenna 241.

Figure 7B:
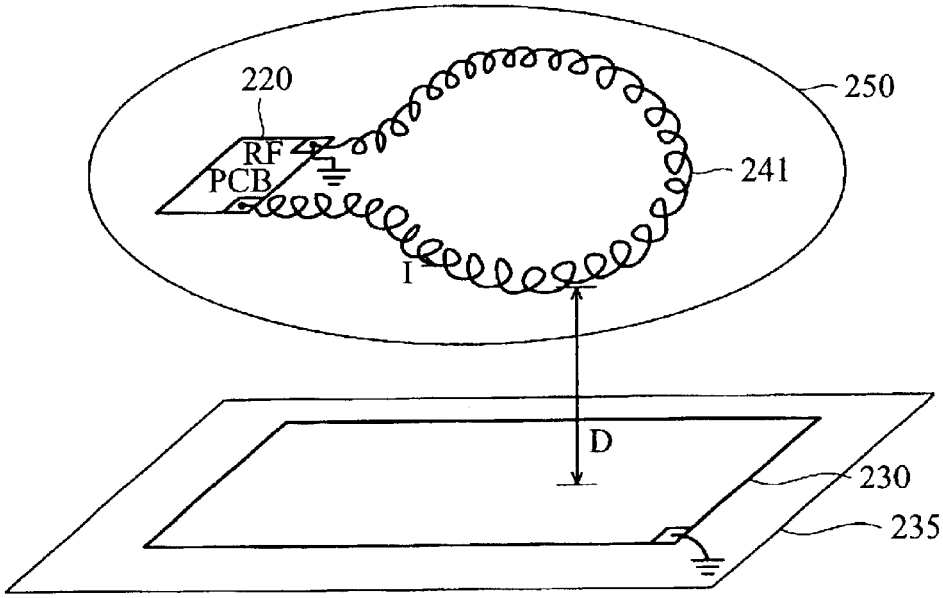

An embodiment of applying a wireless mouse with the circular loop antenna to an environment with a metallic computer table is shown in FIG. 7B. Assuming that the area of the metallic computer table is beyond the area of the circular loop antenna 241, the metallic computer table 235 can be regarded as the ground conductor plate 230. The first end of the circular loop antenna 241 is coupled to the signal end of the RF module 220, and the second end is coupled to the ground end of the RF module 220. When the wireless mouse 250 is on the metallic computer table, the circular loop antenna 241 is above and parallel close to the ground conductor plate 230.

Figure 7C:
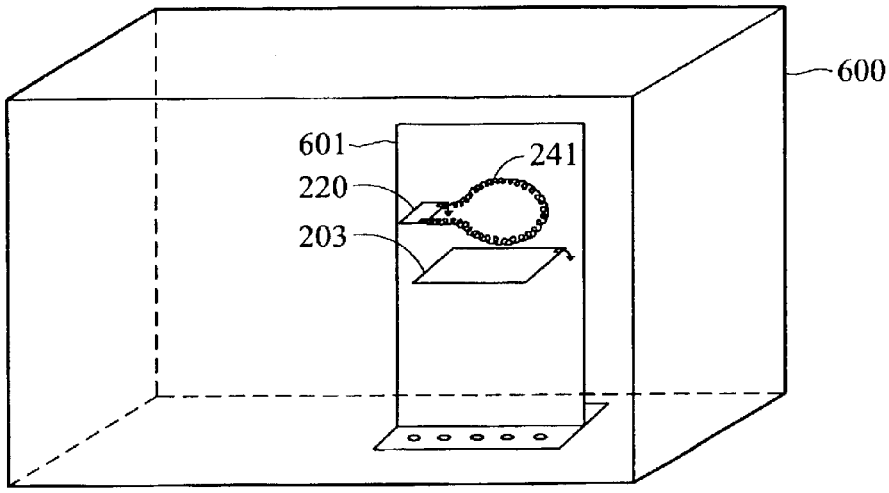

An embodiment of applying the circular loop antenna to the wireless receiver end of the computer system is shown in FIG. 7C. The ground conductor plate 230 is in the computer 600. The first end of the circular loop antenna 241 is coupled to the signal end of the RF module 220, and the second end is coupled to the ground end of the RF module 220. The circular loop antenna 241 is above and parallel close to the ground conductor plate 230. The ground conductor plate 230 is coupled to the ground of the RF module 220 that is the RF module 220 and the ground conductor plate 230 have the same ground.

The Third Embodiment

Figure 9:
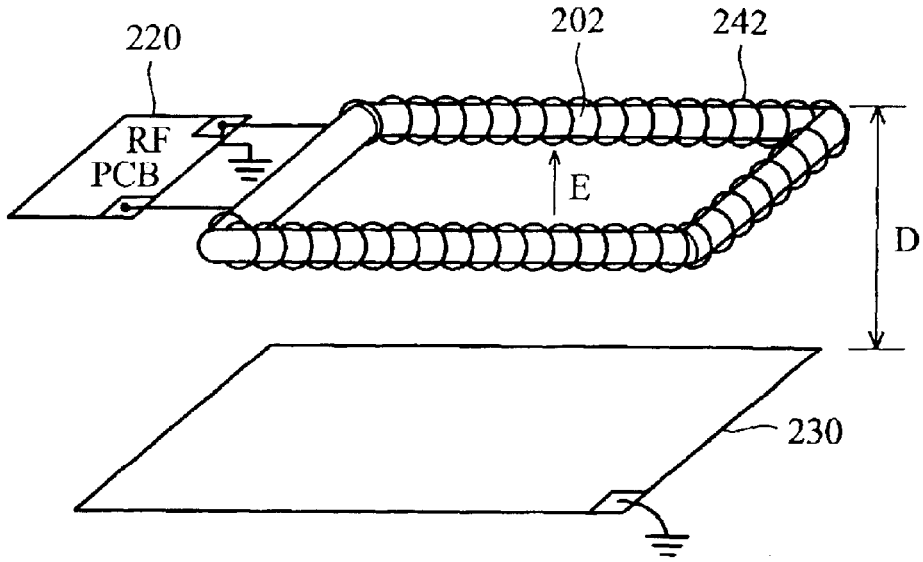
FIG. 9 shows a stereoscope of the loop antenna with a rectangular toroidal helix wire and a circular cross-section.

FIG. 9 shows a stereoscope of the toroidal helix wire of the rectangular loop antenna 242. FIG. 9 discloses an embodiment of a rectangular toroid with a circular cross section. The rectangular loop antenna 242 is formed by a rectangular toroidal helix wire wound on a rectangular toroid 202. Viewed from above, the rectangular toroid 202 is rectangular. Viewed from the side, the rectangular toroid 202 has a circular section. The rectangular toroid 202 can be a ferrite core with a circular cross section or a hollow space enclosed by the rectangular loop antenna 242. The rectangular toroid 202 has a major axis AX1 and a minor axis AX2. The minor axis is a rectangle with a length a of a long side and a length b of a short side. The major axis AX1 is perpendicular to a plane on which the rectangular toroid 202 is located. The rectangular toroid 202 has a circular cross-section. The rectangular toroid 202 is a surface formed by revolving a circle about the major axis.

The Fourth Embodiment

Figure 10:
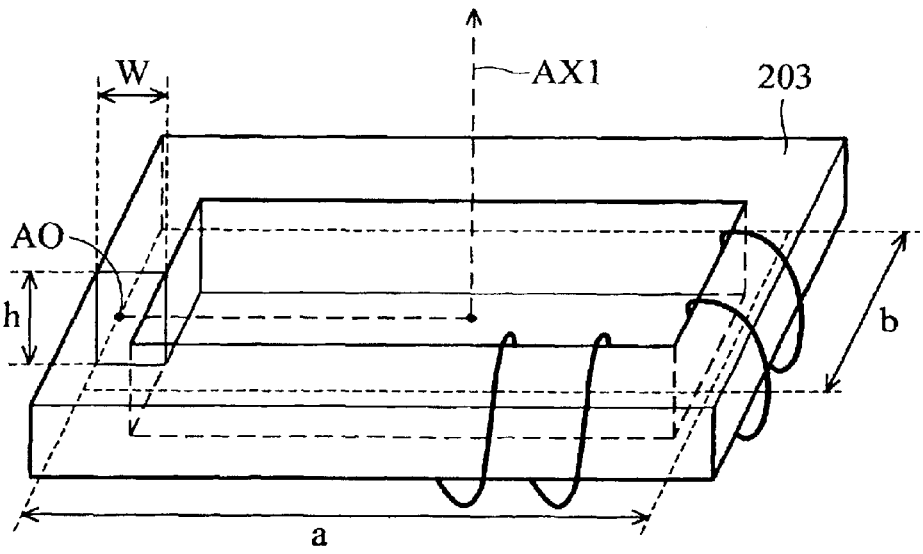
FIG. 10 shows a stereoscope of the loop antenna with a rectangular toroidal helix wire and a rectangular cross-section.

FIG. 10 shows a stereoscope of the toroidal helix wire of the rectangular loop antenna 242. FIG. 10 discloses an embodiment of a rectangular toroid with a rectangular cross section. The rectangular loop antenna 242 is formed by a rectangular toroidal helix wire wound on a rectangular toroid 203. Viewing from the upper, the rectangular toroid 203 is rectangular shape. Viewing from the side, the rectangular toroid 203 has a rectangular section. The rectangular toroid 203 can be a ferrite core with a rectangular cross section or a hollow space enclosed by the rectangular loop antenna 242. The rectangular toroid 203 has a major axis AX1 and a minor axis AX2. The cross-section has a width w and a height h. The minor axis is a rectangle with a length a of a long side and a length b of a short side. The major axis AX1 is perpendicular to a plane on which the rectangular toroid 203 is located. The rectangular toroid 203 has a rectangular cross-section. The rectangular toroid 203 is a surface formed by revolving rectangle about the major axis.

Figure 11A:
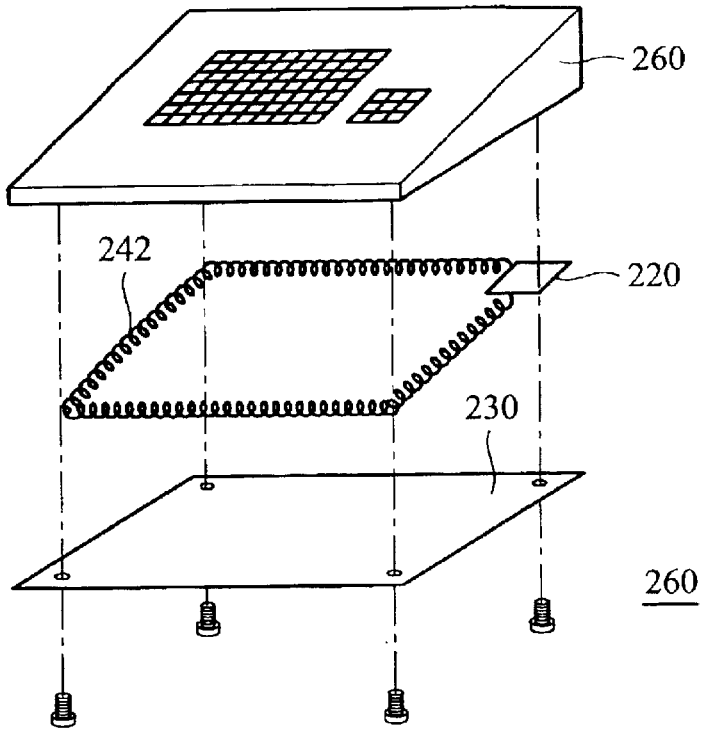
FIGS. 11A–11C shows a diagram rendition of application of the loop antenna with a rectangular toroidal helix wire.
Figure 11B:
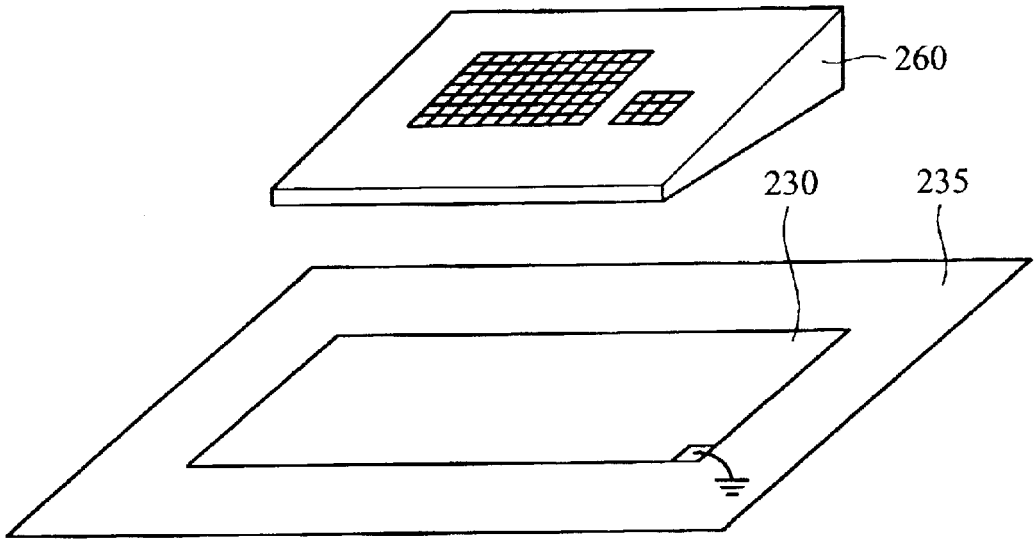
Figure 11C:
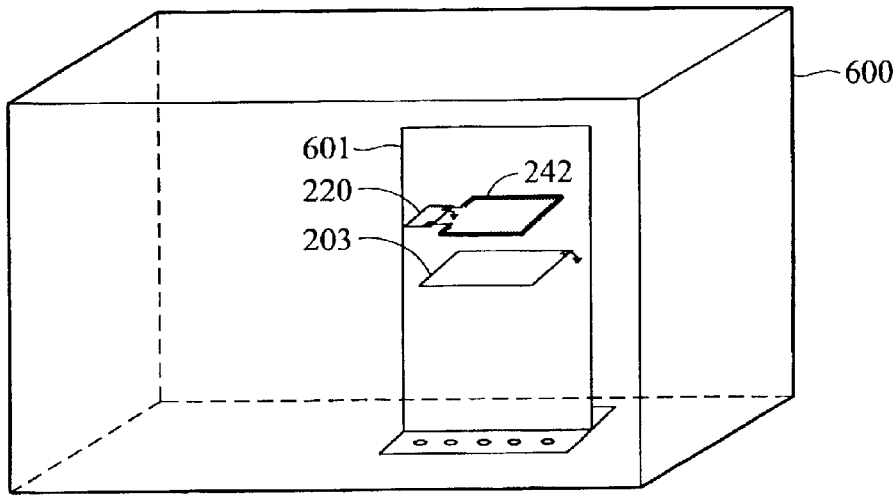

An embodiment of applying the rectangular loop antenna 242 to a wireless keyboard is shown in FIG. 11A. The first end of the rectangular loop antenna 242 is coupled to the signal end of the RF module 220, and the second end is coupled to the ground end of the RF module 220. The ground conductor plate 230 is located at the lower housing of the wireless keyboard. The rectangular loop antenna 242 is located between the upper housing and the ground conductor plate 230. The rectangular loop antenna 242 is above and substantially parallell to the ground conductor plate 230. The ground conductor plate 230 is coupled to the ground of the RF module, thus the RF module 220 and ground conductor plate have the same ground.

Owing to conductive characteristics of the ground conductor plate 230, the tangential electric field of the ground conductor plate 230 being zero can be achieved by replacing the ground conductor plate 230 with an image electric dipole. Because the magnetic current in the rectangular loop antenna 242 is parallel to the ground conductor plate 230, the image magnetic current flows in the same direction and the image electric dipole is in the same direction. Therefore, the image electric dipole enhances the radiation fields of the rectangular loop antenna 242.

An embodiment applying a wireless keyboard to an environment with a metallic computer table is shown in FIG. 7B. The rectangular loop antenna 242 is located between the upper housing and the lower housing of the wireless keyboard. Assuming that the area of the metallic computer table is beyond the area of the rectangular loop antenna 242, the metallic computer table can be regard as the ground conductor plate 230. The first end of the rectangular loop antenna 242 is coupled to the signal end of the RF module 220, and the second end is coupled to the ground end of the RF module 220. When the wireless keyboard is on the metallic computer table, the rectangular loop antenna 242 is above and substantially parallel to the ground conductor plate 230.

Figure 1:
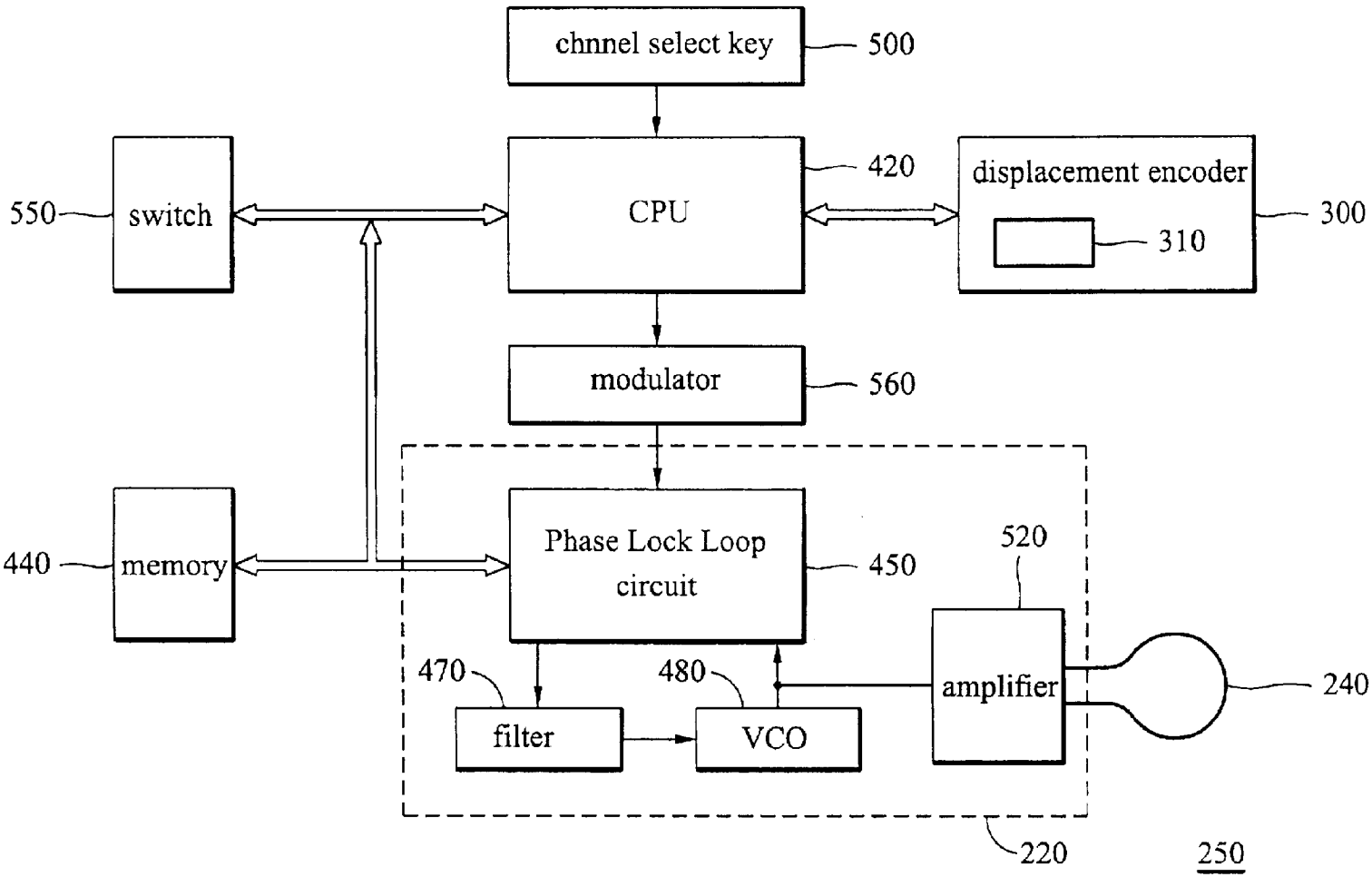
FIG. 1 ( PRIOR ART )
FIG. 1 shows a block diagram of a wireless mouse to which a conventional magnetic dipole loop antenna is applied.
Figure 2:
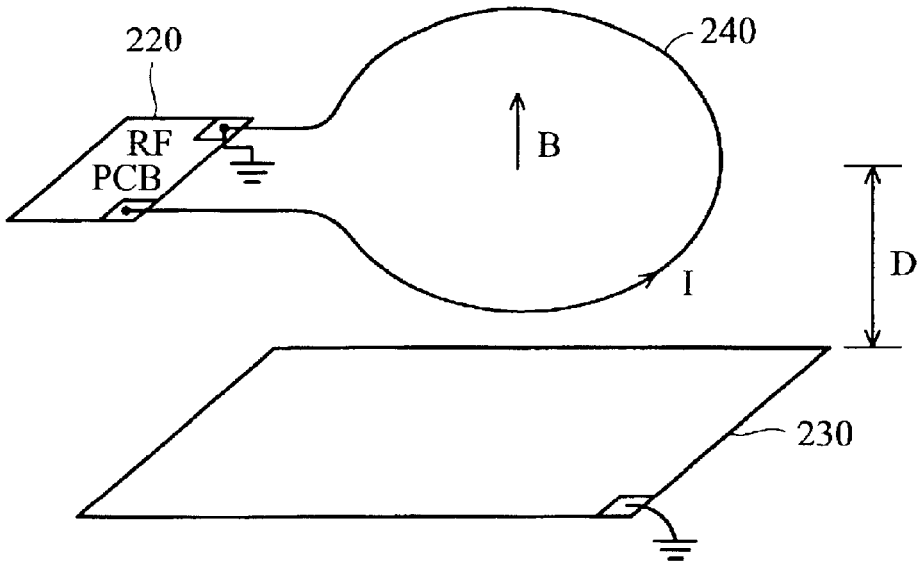
FIG. 2 ( PRIOR ART )
FIG. 2 shows a diagram of the loop antenna and the ground conductor plate.
Figure 3:
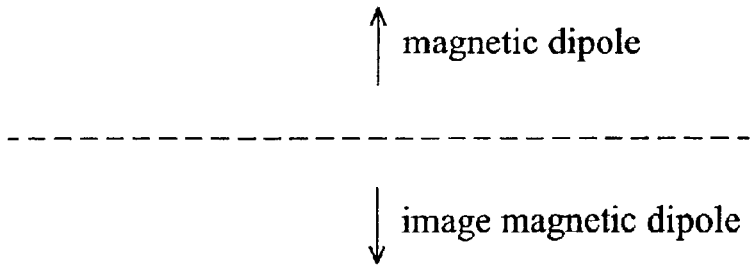
FIG. 3 ( PRIOR ART )
FIG. 3 shows a diagram of a magnetic dipole of a loop antenna and a image magnetic dipole.

An embodiment of applying the rectangular loop antenna to the wireless receiver end of the computer system is shown in FIG. 1C. The ground conductor plate 230 is in the computer 600. The first end of the rectangular loop antenna 242 is coupled to the signal end of the RF module 220, and the second end is coupled to the ground end of the RF module 220. The rectangular loop antenna 242 is above and parallel to the ground conductor plate 230. The ground conductor plate 230 is coupled to the ground of the RF module 220, that is, the RF module 220 and the ground conductor plate 230 have the same ground.

Although the present invention has been described in its preferred embodiment, it is not intended to limit the invention to the precise embodiment disclosed herein. Those who are skilled in this technology can still make various alterations and modifications without departing from the scope and spirit of this invention. Therefore, the scope of the present invention shall be defined and protected by the following claims and their equivalents.

What is claimed is:

1. A loop antenna system for a wireless transmission device having a signal end and a ground end, comprising:

a loop antenna having a toroidal helix wire with a first end coupled to the signal end and a second end coupled to the ground end, wherein the wireless transmission device is a wireless keyboard.

2. The loop antenna system as claimed in claim 1 wherein the top-view of the toroidal helix wire is circular and the cross-section of the toroidal helix wire is circular.

3. The loop antenna system as claimed in claim 2 further comprising a ferrite core enclosed by the toroidal helix wire.

4. The loop antenna system as claimed in claim 1 wherein the top-view of the toroidal helix wire is circular and the cross-section of the toroidal helix wire is rectangular.

5. The loop antenna system as claimed in claim 4 further comprising a ferrite core enclosed by the toroidal helix wire.

6. The loop antenna system as claimed in claim 1 wherein the top-view of the toroidal helix wire is rectangular and the cross-section of the toroidal helix wire is rectangular.

7. The loop antenna system as claimed in claim 6 further comprising a ferrite core enclosed by the toroidal helix wire.

8. The loop antenna system as claimed in claim 1 wherein the wireless keyboard includes a ground conductor plate coupled to the ground end and substantially parallel close to the loop antenna.

9. A loop antenna system for a wireless transmission device having a signal end and a ground end, comprising:

a loop antenna having a toroidal helix wire with a first end coupled to the signal end and a second end coupled to the ground end, wherein the wireless transmission device is a wireless mouse.

10. The loop antenna system as claimed in claim 9 wherein the wireless mouse includes a ground conductor plate coupled to the ground end and substantially parallel close to the loop antenna.

11. A wireless transmission device for transmitting a transmission signal, comprising:

an upper housing and a lower housing;

a ground conductor plate coupled to a ground end and located above the lower housing; and a loop antenna having a helix wire wound on a toroid, wherein the helix wire has a first end coupled to the ground end, the toroid has a principal axis (AX1) and a minor axis (AX2), and the principal (AX1) is perpendicular to the ground conductor plate, and the minor (AX2) is parallel to the ground conductor plate, wherein the loop antenna is located between the upper housing and the ground conductor plate such that the loop antenna is above the ground conductor plate;

wherein when the radio wavelength of the transmission signal is beyond the dimensions of the loop antenna, the magnetic current is distributed along the minor axis (AX2), the electric current is distributed along the principal axis (AX1) and is perpendicular to the ground conductor plate.

12. A wireless transmission device for transmitting a transmission signal, comprising:

a ground conductor plate coupled to a ground end; and a loop antenna having a helix wire wound on a toroid, wherein the helix wire has a first end coupled to the ground end, the toroid has a principal axis (AX1) and a minor axis (AX2), and the principal (AX1) is perpendicular to the ground conductor plate, and the minor (AX2) is parallel to the ground conductor plate;

wherein when the radio wavelength of the transmission signal is beyond the dimensions of the loop antenna, the magnetic current is distributed along the minor axis (AX2), the electric current is distributed along the principal axis (AX1) and is perpendicular to the ground conductor plate;

further comprising an upper housing and a lower housing whereby the loop antenna is located between the upper housing and the ground conductor plate.

13. The wireless transmission device as claimed in claim 12 wherein the top-view of the toroid is circular and the cross-section of the toroid is circular.

14. The wireless transmission device as claimed in claim 12 further comprising a ferrite core enclosed by the toroid.

* * * * *